US010674823B2

(12) United States Patent
Gossens et al.

(10) Patent No.: US 10,674,823 B2
(45) Date of Patent: Jun. 9, 2020

(54) STABILIZING PANEL

(71) Applicant: Electrolux Home Products, Inc., Charlotte, NC (US)

(72) Inventors: Caleb Gossens, Kalamazoo, MI (US); Nicolas Saeger, Pewaukee, WI (US)

(73) Assignee: Electrolux Home Products, Inc., Charlotte, NC (US)

( * ) Notice: Subject to any disclaimer, the term of this patent is extended or adjusted under 35 U.S.C. 154(b) by 126 days.

(21) Appl. No.: 15/846,303

(22) Filed: Dec. 19, 2017

(65) Prior Publication Data

US 2018/0103758 A1 Apr. 19, 2018

Related U.S. Application Data

(63) Continuation of application No. 14/632,215, filed on Feb. 26, 2015, now Pat. No. 9,867,463, which is a continuation of application No. 13/045,652, filed on Mar. 11, 2011, now Pat. No. 9,028,020.

(51) Int. Cl.

| | |
|---|---|
| ***A47B 96/02*** | (2006.01) |
| ***A47B 73/00*** | (2006.01) |
| ***F25D 25/02*** | (2006.01) |

(52) U.S. Cl.

CPC ..... *A47B 96/02* (2013.01); *A47B 73/00* (2013.01); *F25D 25/02* (2013.01); *F25D 2331/805* (2013.01)

(58) Field of Classification Search

CPC ..... A47B 96/02; A47B 73/00; F25D 25/02; F25D 2331/805

See application file for complete search history.

(56) References Cited

U.S. PATENT DOCUMENTS

| | | | |
|---|---|---|---|
| D172,596 | S | 7/1954 | Harper |
| 3,040,923 | A | 6/1963 | Leitzel |
| 3,108,924 | A | 10/1963 | Mountford |
| 3,708,084 | A | 1/1973 | Bixler et al. |
| 3,843,009 | A | 10/1974 | Emery |
| 3,899,805 | A | 8/1975 | McMillan |
| D281,955 | S | 12/1985 | Moller |

(Continued)

OTHER PUBLICATIONS

Mode Studio. Fridge Monkey. http://www.modestudio.co.uk/products-mode-fridge-monkey.php?g=fridge-monkey. Last accessed Feb. 3, 2009.

*Primary Examiner* — Brian Handville

(74) *Attorney, Agent, or Firm* — Pearne & Gordon LLP

(57) ABSTRACT

A stabilizing mat includes a first surface configured to inhibit movement of items placed thereon. The first surface includes a plurality of first parallelogram areas and a plurality of depressions. Each of the first parallelogram areas includes one of the depressions at a center of the first parallelogram area. Each of the first parallelogram areas further includes four first parallelogram corners and four first parallelogram sides. Each of the first parallelogram corners of the first parallelogram areas includes a protruding peak. Each of the protruding peaks is separated from an adjacent one of the protruding peaks by a concavity. Each of the concavities defines one of the depressions. The mat also includes a second surface including a plurality of substantially flat areas configured to rest on a flat foundation to provide support to the items placed on the first surface.

24 Claims, 10 Drawing Sheets

(56) References Cited

U.S. PATENT DOCUMENTS

| | | | | |
|---|---|---|---|---|
| D308,822 | S | 6/1990 | Congleton | |
| D327,841 | S | 7/1992 | Letourneau | |
| 5,201,101 | A | 4/1993 | Rouser et al. | |
| 5,609,942 | A | 3/1997 | Ray | |
| 5,666,777 | A | 9/1997 | Murphy | |
| D396,408 | S | 7/1998 | Carver | |
| 6,932,449 | B2 | 8/2005 | Collins et al. | |
| D518,720 | S | 4/2006 | Gratz | |
| 7,044,358 | B2 | 5/2006 | Gratz | |
| 7,117,994 | B2 | 10/2006 | Gratz | |
| D535,881 | S | 1/2007 | Liukko | |
| 7,267,700 | B2 | 9/2007 | Collins et al. | |
| D655,608 | S | 3/2012 | Taljaard et al. | |
| 2002/0114918 | A1 | 8/2002 | Mossbeck | |
| 2004/0001784 | A1 | 1/2004 | Sullivan et al. | |
| 2004/0031711 | A1 | 2/2004 | O'Malley | |
| 2005/0045648 | A1 | 3/2005 | Mayrose | |
| 2006/0255704 | A1 | 11/2006 | Grobleben et al. | |
| 2007/0220822 | A1 | 9/2007 | Permesang | |
| 2007/0228909 | A1 | 10/2007 | Hwang et al. | |
| 2011/0132853 | A1* | 6/2011 | Drobot ..... | A47B 57/562 211/42 |
| 2012/0061273 | A1 | 3/2012 | Taljaard et al. | |

* cited by examiner

STABILIZING PANEL

CROSS-REFERENCE TO RELATED APPLICATIONS

This application is a continuation of U.S. application Ser. No. 14/632,215 filed on Feb. 26, 2015, which is a continuation of U.S. application Ser. No. 13/045,652, filed on Mar. 11, 2011. These applications are incorporated herein by reference.

FIELD OF INVENTION

The following description relates generally to stabilizing mats and stabilizing mat systems.

BACKGROUND OF INVENTION

The arrangement of shelves inside a cabinet structure such as a refrigerator is such that certain shelves accommodate taller item or items that must be kept upright while other shelves provide space for shorter items or items that can be laid down. Beverages such as bottles and cans can be stored inside a refrigerator by placing them on shelves provided in the compartment or shelves provided on the inside of the door. However, when these spaces are not available, the shelves may not be sufficient to accommodate these items in upright positions and simply laying down the beverage items may not be an alternative because such items are often have round surfaces and may become unstable and roll on the storage surface. Thus, there is a need to enable the usage of the height-restricted spaces at a storage area while stabilizing bottles, cans or other round items when they are laid down.

SUMMARY

The present invention provides a stabilizing mat and a stabilizing mat system.

In a first example aspect, a stabilizing mat includes a first surface configured to inhibit movement of items placed thereon. The first surface includes a plurality of first parallelogram areas and a plurality of depressions. Each of the first parallelogram areas includes one of the depressions at a center of the first parallelogram area. Each of the first parallelogram areas further includes four first parallelogram corners and four first parallelogram sides. Each of the first parallelogram corners of the first parallelogram areas includes a protruding peak. Each of the protruding peaks is separated from an adjacent one of the protruding peaks by a concavity. Each of the concavities defines one of the depressions. The mat also includes a second surface including a plurality of substantially flat areas configured to rest on a flat foundation to provide support to the items placed on the first surface.

In one example of the first aspect, the depressions are configured to inhibit movement of the items placed on the first surface. In another example of the first aspect, each of the protruding peaks is connected to an adjacent one of the protruding peaks by the concavity. In yet another example of the first aspect, each of the protruding peaks is aligned longitudinally, transversely, and diagonally with respect to adjacent ones of the protruding peaks.

In a further example of the first aspect, the first surface further includes four first surface edges and four first surface corners. Each of the first surface corners includes one of the protruding peaks. Each of the first surface edges includes a plurality of the protruding peaks and a plurality of concavities.

In yet another example of the first aspect, the second surface is further configured to support the items. The protruding peaks are configured to rest on the flat foundation to provide support to the second surface to support the items.

In still another example of the first aspect, the protruding peaks include a first set of the protruding peaks and a second set of the protruding peaks. The first set of the protruding peaks have an elevation that is greater than an elevation of the second set of the protruding peaks.

In an additional example of the first aspect, a midpoint between two of the protruding peaks defines a center of one of the depressions.

In another example of the first aspect, a first one of the concavities between two of the protruding peaks has a first radius of curvature about a first axis. A second one of the concavities between another two of the protruding peaks has a second radius of curvature about a second axis. The second one of the concavities intersects the first one of the concavities. The first axis and the second axis intersect each other.

In yet another example of the first aspect, the second one of the concavities perpendicularly intersects the first one of the concavities. The first axis and the second axis perpendicularly intersect each other.

In still another example of the first aspect, the first axis is parallel to two opposing edges of the first surface. The second axis is parallel to two other opposing edges of the first surface. In an additional example of the first aspect, the first radius of curvature is equal to the second radius of curvature.

In another example of the first aspect, each concavity is configured to separate one of the items placed on the first surface from an adjacent one of the items placed on the first surface. In a further example of the first aspect, each concavity is further configured to separate the one of the items from the adjacent one of the items to allow another one of the items to be supported by the one of the items and the adjacent one of the items.

In yet another example of the first aspect, the mat further includes male connecting sections positioned on two adjacent second surface edges of the second surface. The mat also further includes female connecting sections positioned on two adjacent first surface edges of the first surface. The male connecting sections are positioned on sides of the second surface that oppose sides of the first surface on which the female connecting sections are positioned.

In still another example of the first aspect, the first surface is diagonally offset about the second surface. In an additional example of the first aspect, edges of the first surface are offset from edges of the second surface that are adjacent to the edges of the first surface.

In a second example aspect, a stabilizing mat system includes a first mat including a first surface and a second surface. The first mat first surface is configured to inhibit movement of items placed thereon. The first mat first surface includes a plurality of first mat first parallelogram areas and a plurality of first mat depressions. Each of the first mat first parallelogram areas includes one of the first mat depressions at a center of the first mat first parallelogram area. Each of the first mat first parallelogram areas further includes four first mat first parallelogram corners and four first mat first parallelogram sides. Each of the first mat first parallelogram corners of the first mat first parallelogram areas includes a first mat protruding peak. Each of the first mat protruding peaks is separated from an adjacent one of the first mat protruding peaks by one of the first mat depressions. The first mat second surface includes a plurality of first mat substantially flat areas and first mat male connecting sections. The first mat substantially flat areas are configured to rest on a flat foundation to provided support to the items placed on the first mat first surface. The first mat male connecting sections protrude from and are positioned on two adjacent first mat second surface edges of the first mat second surface.

The stabilizing mat system also includes a second mat including a first surface and a second surface. The second mat first surface is configured to inhibit movement of items placed thereon. The second mat first surface includes a plurality of second mat first parallelogram areas, a plurality of second mat depressions, and second mat female connecting sections protruding from and positioned on two adjacent second mat first surface edges of the second mat first surface. Each of the second mat first parallelogram areas includes one of the second mat depressions at a center of the second mat first parallelogram area. Each of the second mat first parallelogram areas further includes four second mat first parallelogram corners and four second mat first parallelogram sides. Each of the second mat first parallelogram corners of the second mat first parallelogram areas includes a second mat protruding peak. Each of the second mat protruding peaks is separated from an adjacent one of the second mat protruding peaks by one of the second mat depressions. The second mat second surface includes a plurality of second mat substantially flat areas configured to rest on the flat foundation to provided support to the items placed on the second mat first surface. One of the first mat male connecting sections is configured to mate with a corresponding one of the second mat female connecting sections.

In one example of the second aspect, the system further includes a third mat including a first surface and a second surface. The third mat first surface is configured to inhibit movement of items placed thereon. The third mat first surface includes a plurality of third mat first parallelogram areas and a plurality of third mat depressions. Each of the third mat first parallelogram areas includes one of the third mat depressions at a center of the third mat first parallelogram area. Each of the third mat first parallelogram areas further includes four third mat first parallelogram corners and four third mat first parallelogram sides. Each of the third mat first parallelogram corners of the third mat first parallelogram areas includes a third mat protruding peak. Each of the third mat protruding peaks is separated from an adjacent one of the third mat protruding peaks by one of the third mat depressions. The third mat second surface includes a plurality of third mat substantially flat areas and third mat male connecting sections. The third mat substantially flat areas are configured to rest on a flat foundation to provided support to the items placed on the third mat first surface. The third mat male connecting sections protrude from and are positioned on two adjacent third mat second surface edges of the third mat second surface.

The first mat further includes first mat female connecting sections protruding from and being positioned on two adjacent first mat first surface edges of the first mat first surface. The two adjacent first mat first surface edges on which the first mat female connecting sections are positioned are respectively opposed to the two adjacent first mat second surface edges on which the first mat male connecting sections are positioned. One of the third mat male connecting sections is configured to mate with a corresponding one of the first mat female connecting sections.

In another example of the second aspect, the system further includes a fourth mat including a first surface and a second surface. The fourth mat first surface is configured to inhibit movement of items placed thereon. The fourth mat first surface includes a plurality of fourth mat first parallelogram areas and a plurality of fourth mat depressions. Each of the fourth mat first parallelogram areas includes one of the fourth mat depressions at a center of the fourth mat first parallelogram area. Each of the fourth mat first parallelogram areas further includes four fourth mat first parallelogram corners and four fourth mat first parallelogram sides. Each of the fourth mat first parallelogram corners of the fourth mat first parallelogram areas includes a fourth mat protruding peak. Each of the fourth mat protruding peaks is separated from an adjacent one of the fourth mat protruding peaks by one of the fourth mat depressions. The fourth mat second surface includes a plurality of fourth mat substantially flat areas and fourth mat male connecting sections. The fourth mat substantially flat areas are configured to rest on a flat foundation to provided support to the items placed on the fourth mat first surface. The fourth mat male connecting sections protrude from and are positioned on two adjacent fourth mat second surface edges of the fourth mat second surface.

The system further includes a fifth mat including a first surface and a second surface. The fifth mat first surface being configured to inhibit movement of items placed thereon. The fifth mat first surface includes a plurality of fifth mat first parallelogram areas, a plurality of fifth mat depressions, and fifth mat female connecting sections protruding from and positioned on two adjacent fifth mat first surface edges of the fifth mat first surface. Each of the fifth mat first parallelogram areas includes one of the fifth mat depressions at a center of the fifth mat first parallelogram area. Each of the fifth mat first parallelogram areas further includes four fifth mat first parallelogram corners and four fifth mat first parallelogram sides. Each of the fifth mat first parallelogram corners of the fifth mat first parallelogram areas includes a fifth mat protruding peak. Each of the fifth mat protruding peaks is separated from an adjacent one of the fifth mat protruding peaks by one of the fifth mat depressions. The fifth mat second surface includes a plurality of fifth mat substantially flat areas configured to rest on the flat foundation to provided support to the items placed on the fifth mat first surface.

Another one of the first mat female connecting sections is configured to mate with a corresponding one of the fourth mat male connecting sections. Another one of the first mat male connecting sections is configured to mate with a corresponding one of the fifth mat female connecting sections. The second mat is positioned on an opposite side of the first mat from the third mat. The fourth mat is positioned on an opposite side of the first mat from the fifth mat.

Other features and aspects may be apparent from the following detailed description, the drawings, and the claims.

Figure 1:
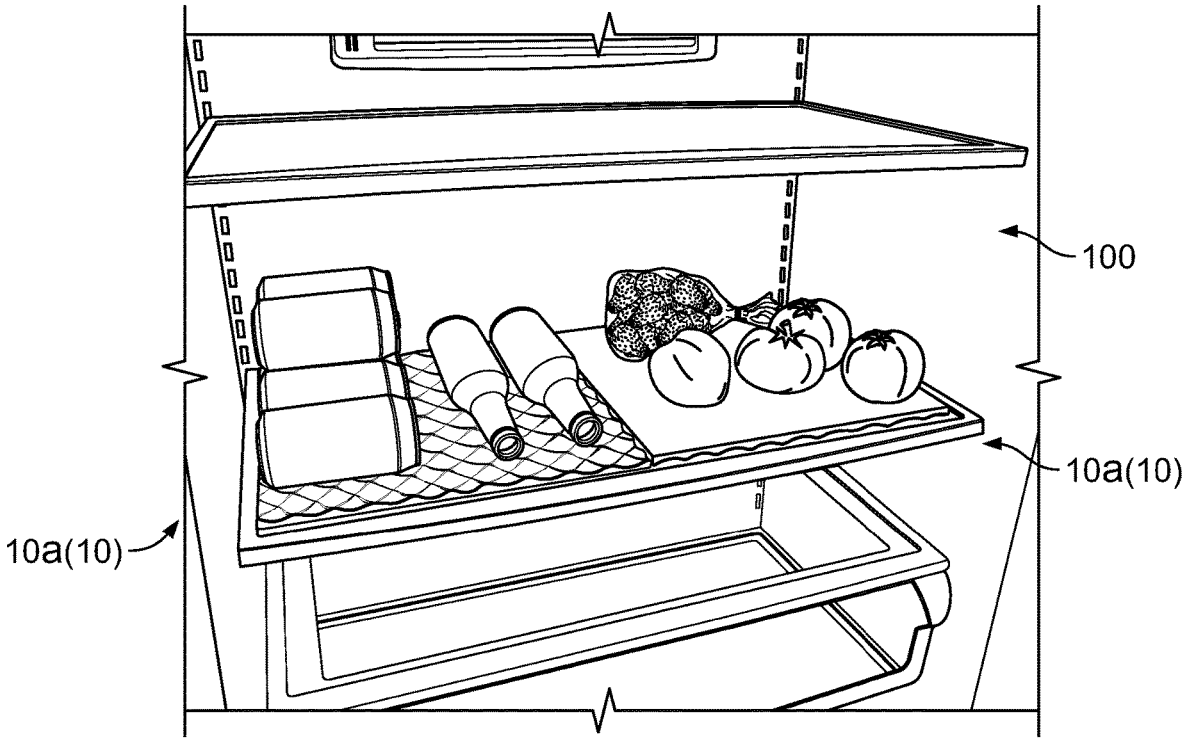
FIG. 1 is a view of a first example embodiment of a stabilizing panel in accordance with the present invention inside a cabinet structure.

Throughout the drawings and the detailed description, unless otherwise described, the same drawing reference numerals will be understood to refer to the same elements, features, and structures. The relative size and depiction of these elements may be exaggerated for clarity, illustration, and convenience.

DETAILED DESCRIPTION

Examples incorporating one or more embodiments are described and illustrated in the drawings. These illustrated examples are not intended to be limiting. For example, one or more aspects of an embodiment may be utilized in other embodiments and even other types of devices.

FIG. 1 shows one embodiment of a stabilizing panel 10 in accordance with the present invention. The stabilizing panel 10 may be a structure that provides a substantially planar surface that can stabilize items placed thereon. The stabilizing panel 10 may be embodied as a flexible or pliable object such as a mat 10*a* (FIG. 1) which can be laid down on a surface but needs an underlying foundation to form the substantially planar surface and support items placed thereon. The stabilizing panel 10 may also be embodied as a firm or rigid object such as a shelf 10*b* (FIG. 7) that can provide a foundation and a planar surface on which to support the items. Thus, the expression 'stabilizing panel' should be construed broadly to encompass a mat and a shelf, but should not exclude other objects which are described as a pad, a cushion, a layer, a bed, a stratum, a tray, a receptacle, a board, a dish, a support or the like.

One example of the stabilizing panel is shown in FIG. 1 embodied as what may also be described as a mat 10*a*. The stabilizing panel 10 may be laid on any flat surface which may be inside an interior of an enclosed compartment that is also a temperature-controlled environment such as a refrigerator 100, a wine cellar, a freezer, or the like or in other storage areas. In this embodiment, the stabilizing panel 10 is substantially a rectangle in its entirety although other polygonal shapes are also contemplated. For example, the stabilizing panel 10 may have a parallelogram shape such as a square or be cross-shaped, L-shaped, frame-like, or otherwise. As shown in FIG. 1, the stabilizing panel 10 is configured with features that, as will be described below, enable the stabilizing panel 10 to stabilize, immobilize, firmly hold or otherwise support items with round surfaces, such as bottles or cans, so that the items do not roll or move in an undesired manner when laid down.

Figure 2B:
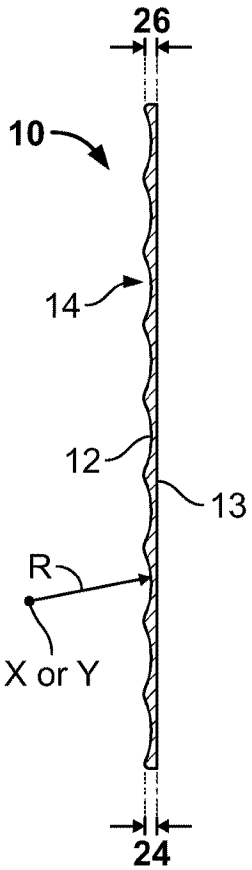
FIG. 2B is a profile view of a diagonal cross-section of the stabilizing panel.
Figure 2C:
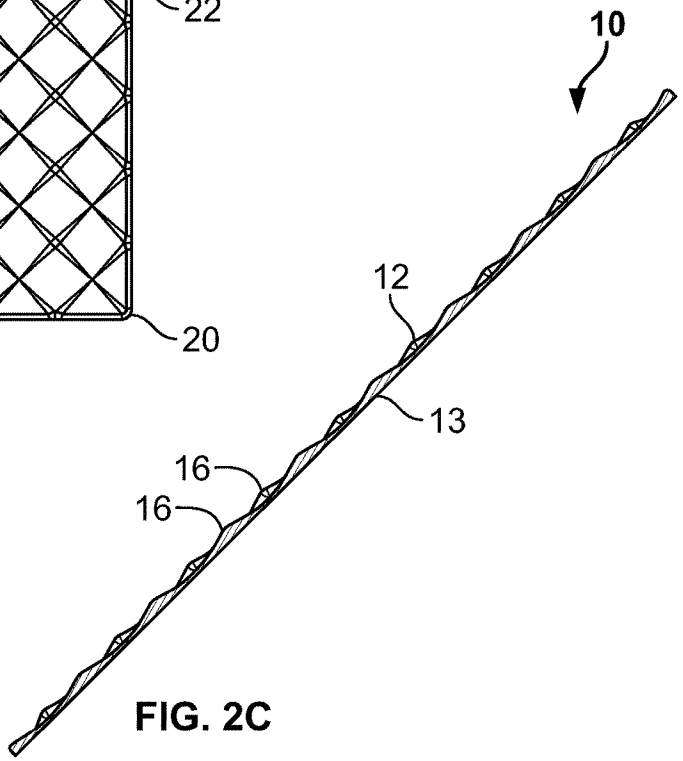
FIG. 2C is a profile view of a longitudinal cross-section of the stabilizing panel.
Figure 2A:
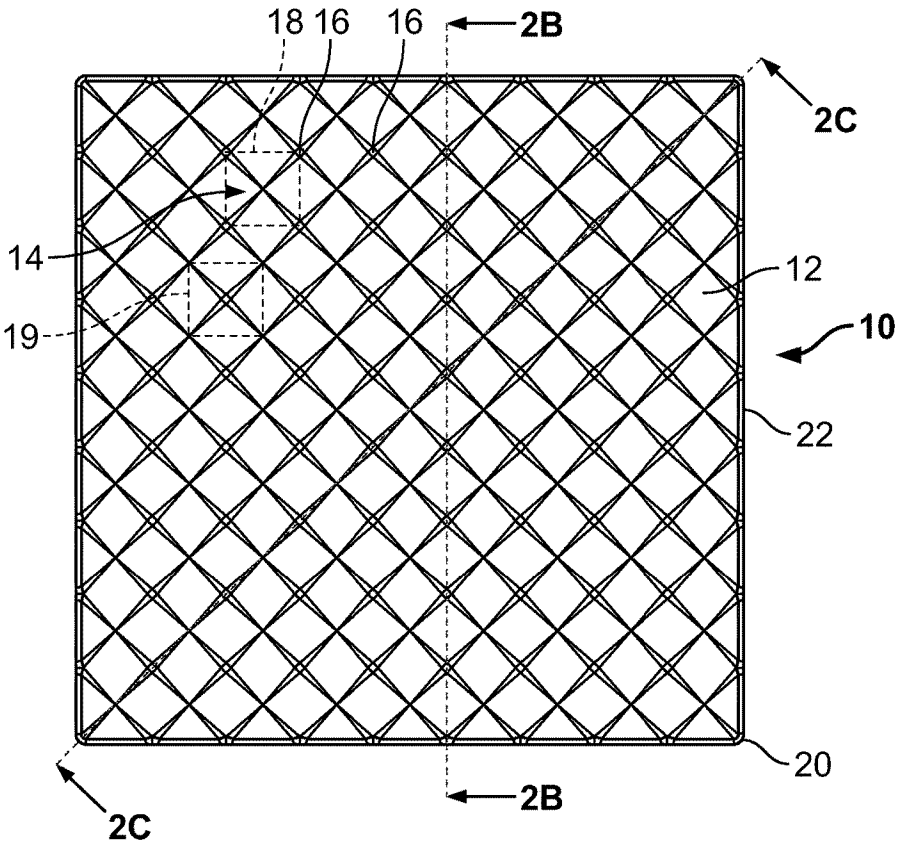
FIG. 2A is a top view of the stabilizing panel.

As shown in FIGS. 2A-2C, a first surface 12 of the stabilizing panel 10 includes a plurality of depressions 14 in which the aforementioned items can be placed and be substantially immobilized. The depressions 14 can be contrasted with a plurality of protruding peaks 16 which may be aligned longitudinally and transversely on the first surface 12 so that an orthogonal grid pattern would be formed if the peaks 16 were connected. However, other alternative arrangements of the peaks 16 are not excluded from contemplation. For example, the arrangement of the peaks 16 may form a grid in which the peaks 16 are aligned along or to be parallel with two orientations that are not perpendicular to one another. A single depression 14 may occupy a parallelogram area 18 on the first surface 12 such that the first surface 12 may be divisible into a plurality of equally sized, parallelogram areas 18 so that each parallelogram area 18 defines a single depression 14 as in FIG. 2A. Each parallelogram area 18 has four corners 20 and four edges 22, and each peak 16 is located at a corner 20 of a parallelogram area 18. It is not necessary for the entire first surface 12 to be divisible into a number of complete parallelogram areas 18. For example, the first surface 12 may be made up of complete and incomplete parallelogram areas 18.

It must be noted that, while the embodiment shown in FIG. 1 shows a square-shaped parallelogram area 18, the parallelogram area 18 may shaped as a parallelogram, a rhombus, a rectangle or the like in alternative embodiments of the stabilizing panel 10. In these embodiments with alternatively shaped parallelogram areas 18, the sides of the parallelogram areas 18, in which the opposing sides are parallel to one another, may define two orientations which the peaks 16 may be aligned to be parallel with. In other words, the arrangement of identically shaped, adjacent parallelogram areas 18 may be such that the sides become aligned.

As shown in FIG. 2B, the stabilizing panel 10 that is embodied as a mat 10*a* may also include a second surface 13 that is substantially flat without any protrusions. The corners 20 and the edges 22 of the first surface 12, regardless of the shape of the stabilizing panel 10, may each have a peak 16 so that, in case the stabilizing panel 10 is flipped upside down, the peaks 16 on the first surface 12 act as supporting structures so that the second surface 13 is kept flat and does not bend downward at the edges 22.

Figure 6:
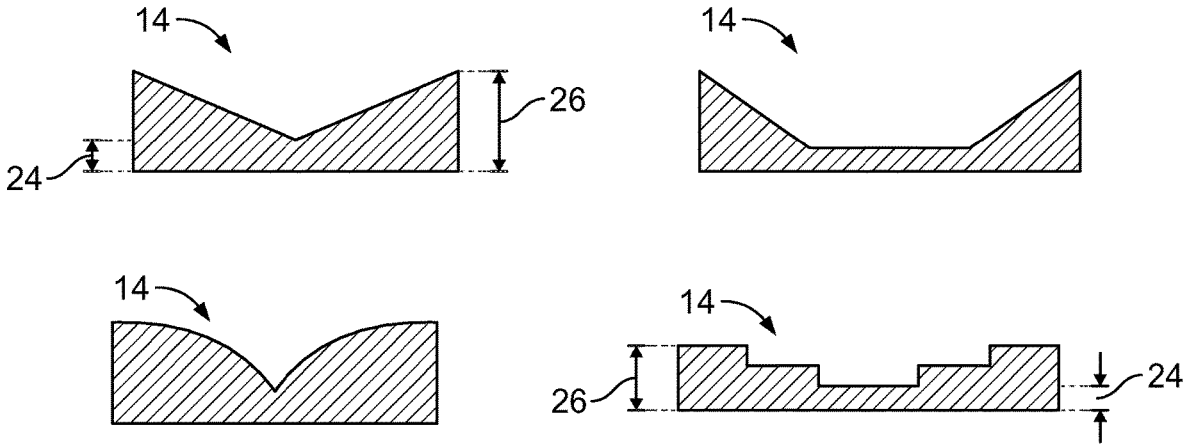
FIG. 6 is an illustration of the depression with alternative cross-sectional shapes.

As shown in FIGS. 2B and 6, the first surface 12 may range from a first elevation 24, where the first surface 12 may be at its lowest, to a second elevation 26 that is higher than the first elevation 24 and to which the peaks 16 may rise. It is also contemplated that the first surface 12 may include one or more additional elevations that are different from the first elevation 24 and the second elevation 26 and the range of elevation may differ in one part of the first surface 12 compared to another part of the first surface 12.

Figure 4A:
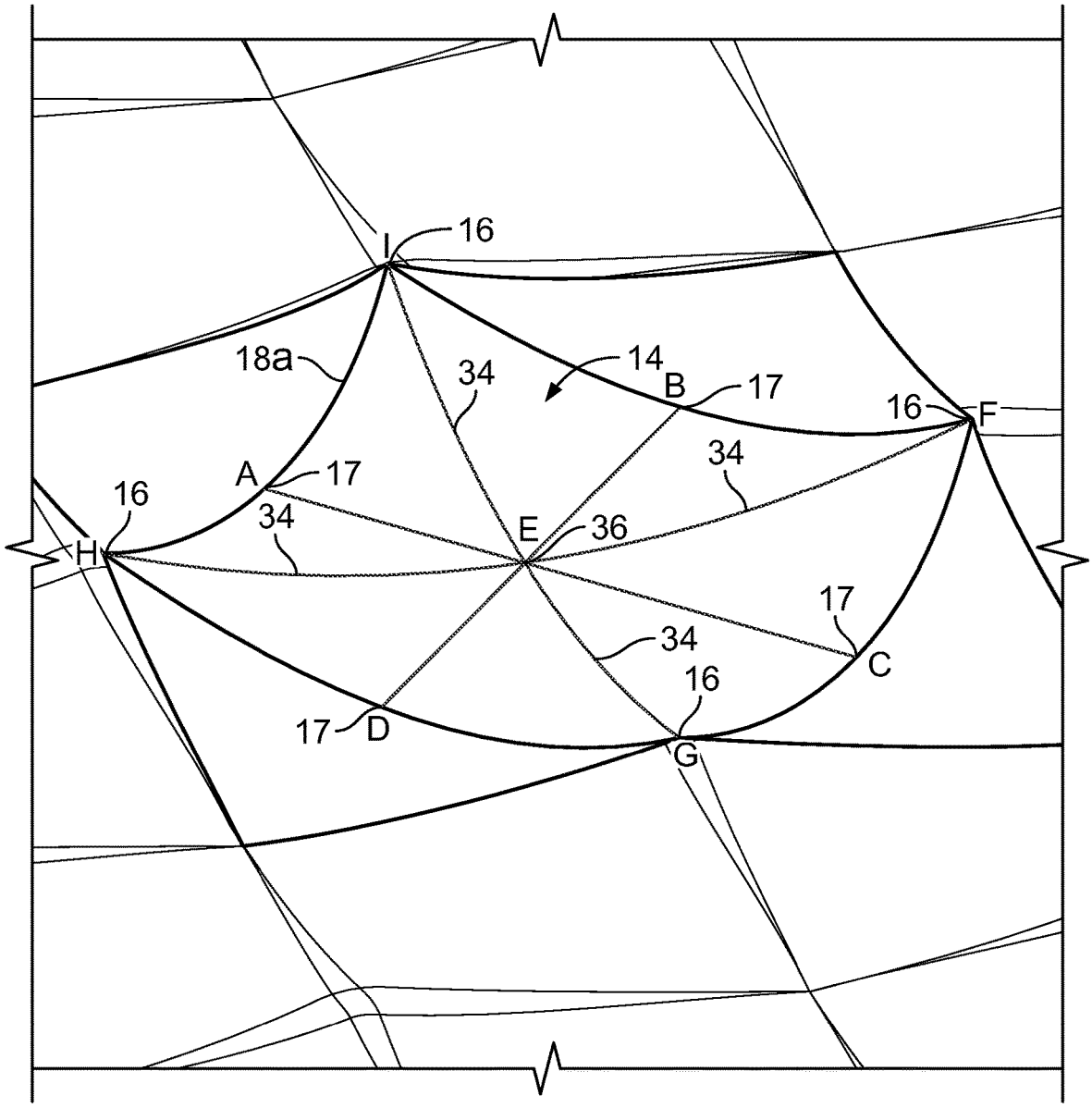
FIG. 4A is a close-up view of a squared area of the stabilizing panel with a depression and peaks.

In this embodiment, the midpoint of two longitudinally or transversely closest peaks 16 is at the first elevation 24, and the midpoint 17 of two closest peaks 16 is also at the first elevation 24 while the peaks 16 are at the second elevation 26 as shown in FIG. 4A. In other words, points A, B, C, D (midpoints) and E (center of depression) are at the first elevation 24 while points F, G, H, and I (peaks) are at the second elevation 26.

Figure 3:
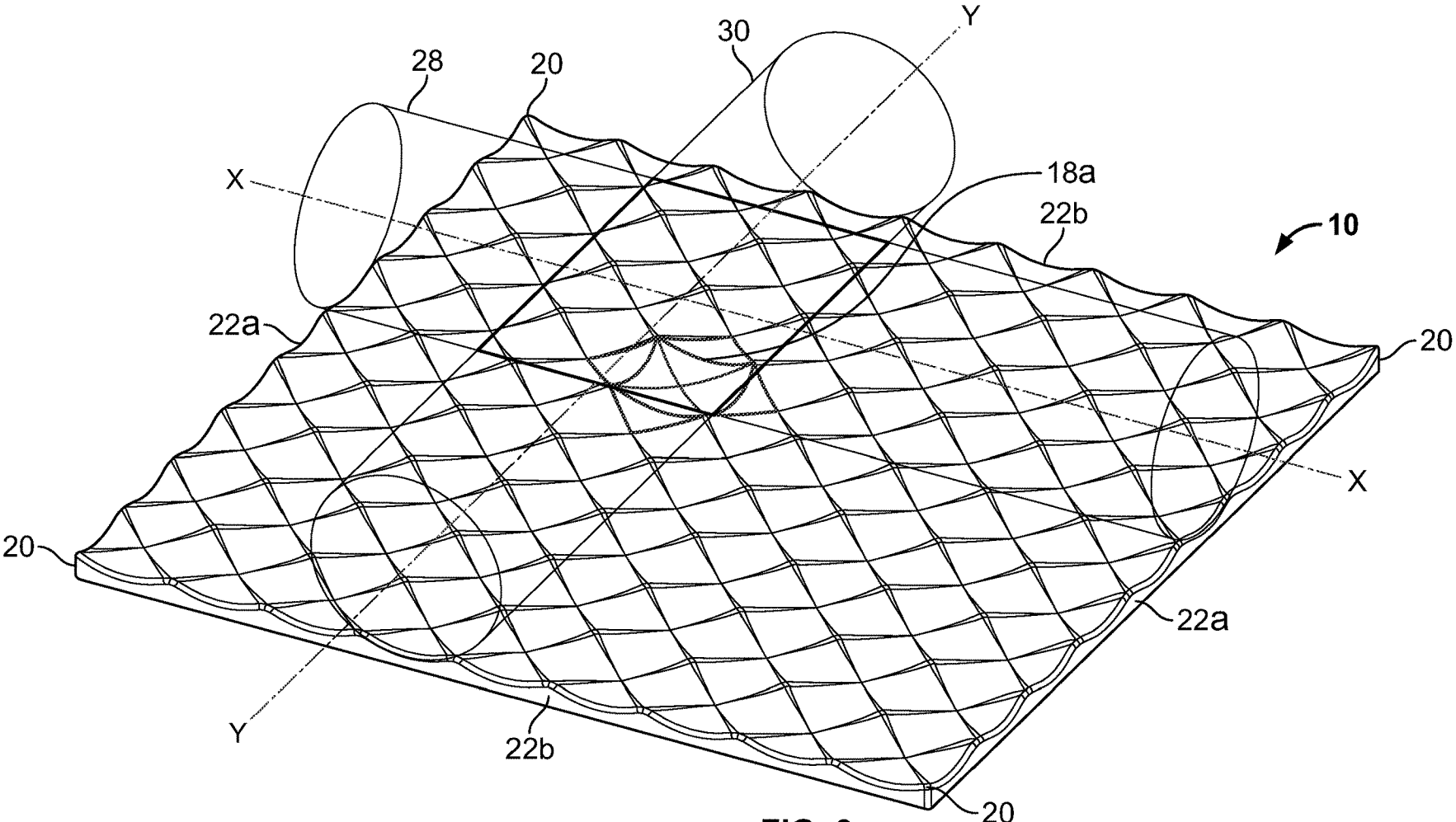
FIG. 3 is a perspective view of the stabilizing panel.

The geometry of the depression 14 can be explained as follows and shown in FIGS. 2B and 3. In each parallelogram area 18, one depression 14 has a constant radius of curvature R of about 1.3 inches with respect to a first axis X that is located above the first surface 12. At the same time, one depression 14 also has a constant radius of curvature R of about 1.3 inches about a second axis Y that is also located above the first surface but is perpendicular to the first axis X. This is illustrated in FIG. 3, which shows two cylinders 28, 30 whose radii have the same value R and whose axes X, Y intersect perpendicularly. As shown in FIG. 3, the first axis X may be parallel to the longitudinal edges 22*a* of the stabilizing panel 10 while the second axis Y may be parallel to the transverse edges 22*b* of the stabilizing panel 10. The resulting parallelogram area 18*a* near the intersection of the two cylinders 28, 30 will have a depression 14 with the same radius of curvature R about axis X and about axis Y. The depression 14 includes ridges 34 that are diagonally oriented and are formed as the peaks 16 at the second elevation 26 gradually transitions to the center 36 of the depression 14 that is at the first elevation 24. Each parallelogram area 18 of the first surface 12 may have a depression 14 with identical geometry. The same radii of curvature enable an item to be stabilized in the same manner whether the item is placed along two different orientations, which may be longitudinal and transversal for example, on the stabilizing panel 10.

However, in alternative embodiments of the stabilizing panel 10, the geometry of the first surface 12 may vary and have different or no curvatures, different elevations, or the like.

Figure 4B:
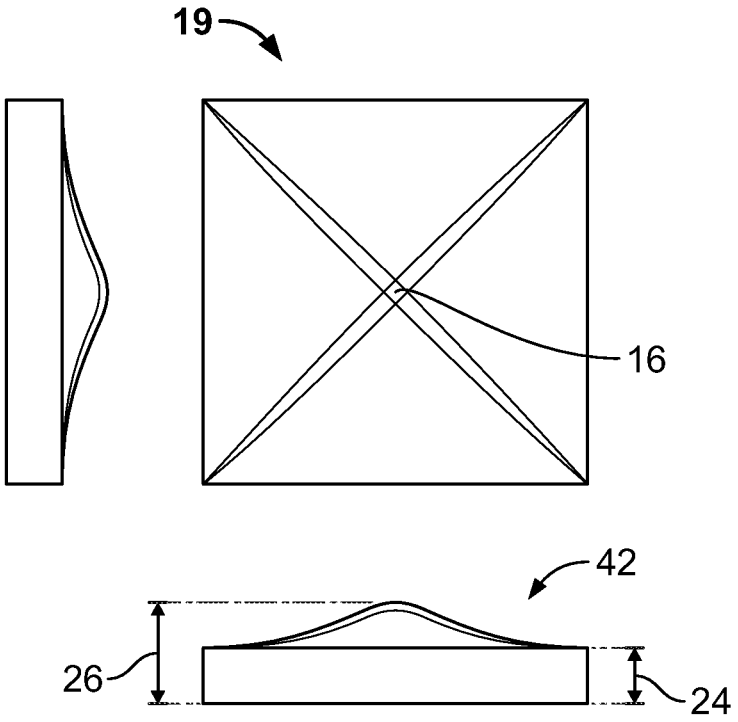
FIG. 4B are top and side views of an alternative squared area shown in an isolated state.
Figure 4C:
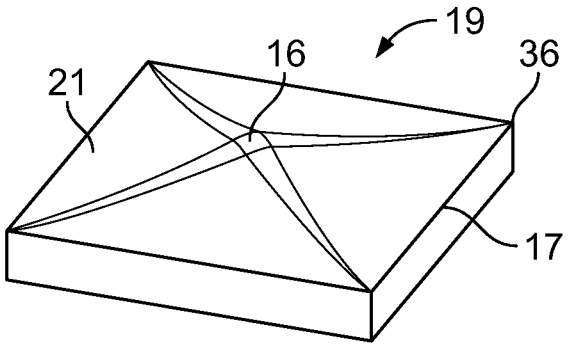
FIG. 4C is a perspective view of the alternative squared area shown in an isolated state.

The same geometry of the first surface 12 can also be described by dividing the first surface 12 into alternatively selected parallelogram areas 19 shown in FIG. 2A. FIGS. 4B and 4C show the alternatively selected parallelogram area 19 detached from the stabilizing panel 10 and including only a single peak 16. The alternative parallelogram area 19 may include a substantially pyramidal or diamond configuration formed by four substantially triangular surfaces 21. The four triangular surfaces 21 may be concave as shown in FIG. 4B and each have a radius of curvature of R as discussed above. Thus, the peak 16 is defined by a tip of a substantially pyramid or diamond protrusion 42. The four triangular surfaces 21 meet to form the peak 16. The center 36 of depression 14 and the midpoint 17 of two closest peaks 16 are also indicated in FIG. 4C. Under the above dimensions, the distance between two closest peaks 16 are 1.38 inches.

Figure 5:
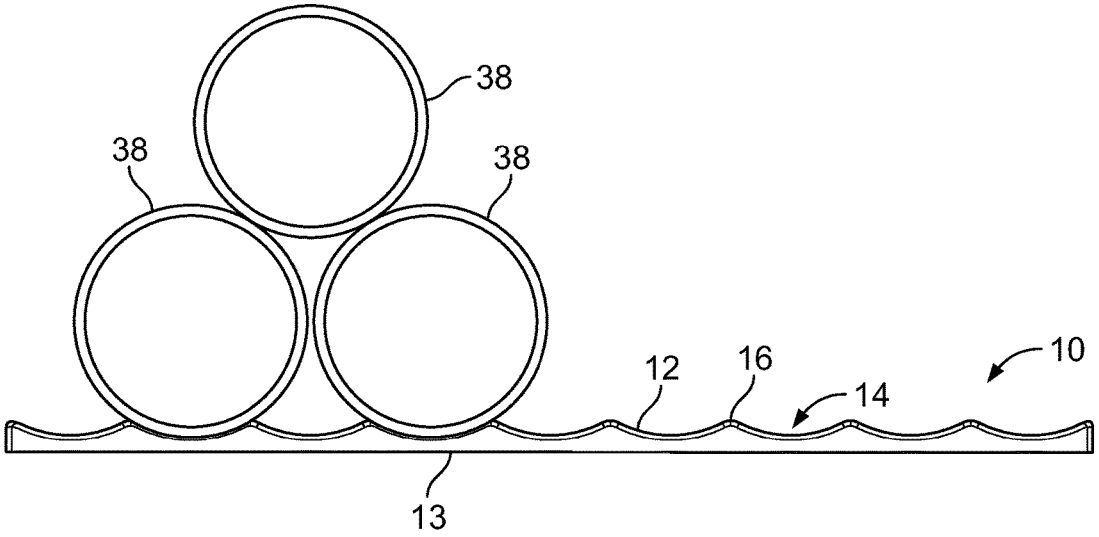
FIG. 5 is a side profile view of the stabilizing panel with items placed on a first surface.

The radius of curvature R of the depression 14 and the distance between peaks 16 are likely to be affected by the types of items 38 that are placed on the stabilizing panel 10. For example, if the contour of the item 38 is closely matched by the geometry of the depression 14, the degree of stability is likely to be higher. Moreover, as shown in FIG. 5, the dimensions of the depression 14 may also be adjusted so that two items 38, which are placed on the first surface 12 adjacent one another but separated by a depression 14, are kept apart but are sufficiently close so that an additional item 38 may be stacked above an in between the two items 38. If the round surface of the item 38 has a different radius of curvature, adjusting the radius of curvature of the depression to match this curvature may result in a more accommodating or versatile stabilizing panel 10. As mentioned above, it may be possible to have a stabilizing panel 10 in which different parts of the first surface 12 have different radii of curvature.

The resulting stability may also be affected by the material of which the stabilizing panel 10 is made. For example, the stabilizing panel 10 may be made of elastomers such as rubber that are likely to create a high coefficient of friction and improve stability for items placed on the stabilizing panel 10. However, the stabilizing panel 10 may also be made of material such as polymers which may simply offer the benefits arising from geometry but not the frictional benefits.

Although in the shown embodiment the first surface 12 transitions from the minimum elevation 24 to the maximum elevation 26 through concave surfaces, the depressions 14 in the parallelogram areas 18 may also be formed from other types of surfaces that are flat, angled, convex, stepped or otherwise. For example, the depressions 14 may be formed such that the depressions 14 have cross-sectional views shown in FIG. 6. The maximum elevation 26 need not be a point but may also be a line or a plane.

Figure 7:
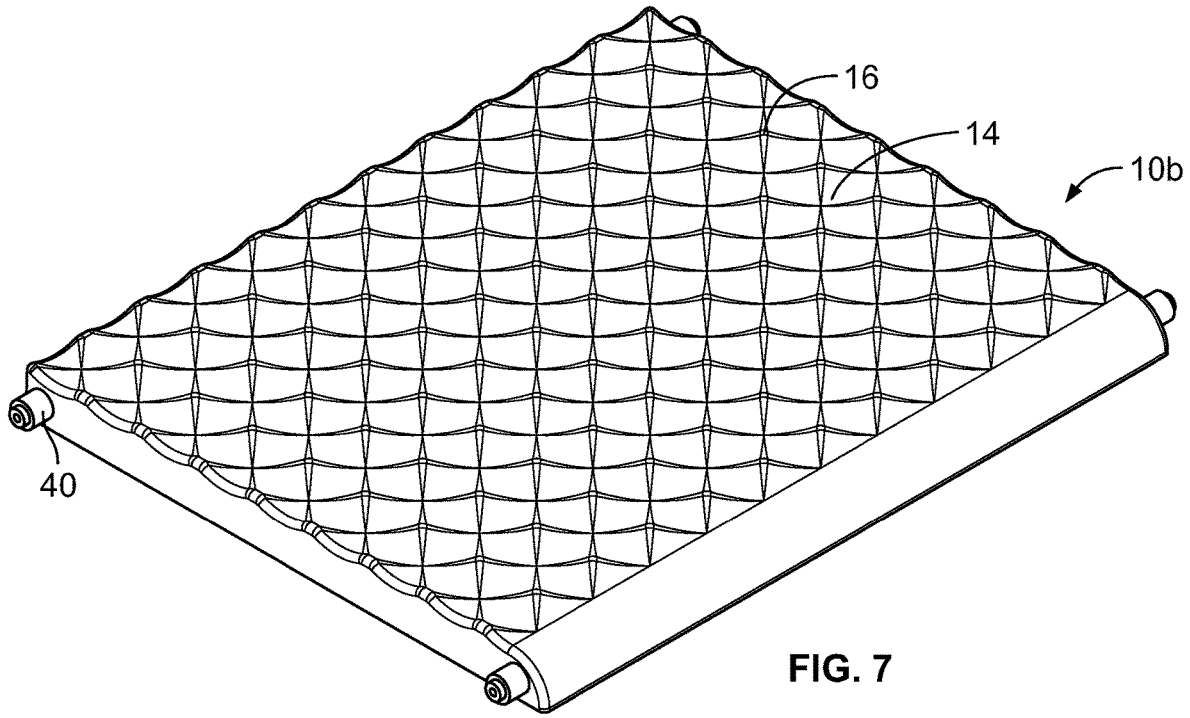
FIG. 7 is a view of a second example embodiment of the stabilizing panel.

It is possible to form a stabilizing panel 10 in other types of embodiments such as a shelf 10*b* that is part of a cabinet structure such as a refrigerator 100. FIG. 7 shows a second embodiment in which a top surface of the shelf is configured with peaks 16 and depressions 14. The peaks 16 and depressions 14 may be molded integrally to the shelf 10*b* or can be formed by a separate piece that is glued to the shelf 10*b*. The shelf 10*b* may be attachable and detachable from the cabinet structure through pins 40 that are received by receptacles inside the cabinet structure. This embodiment may be mounted upside down so as to provide a second surface as well.

Figure 8A:
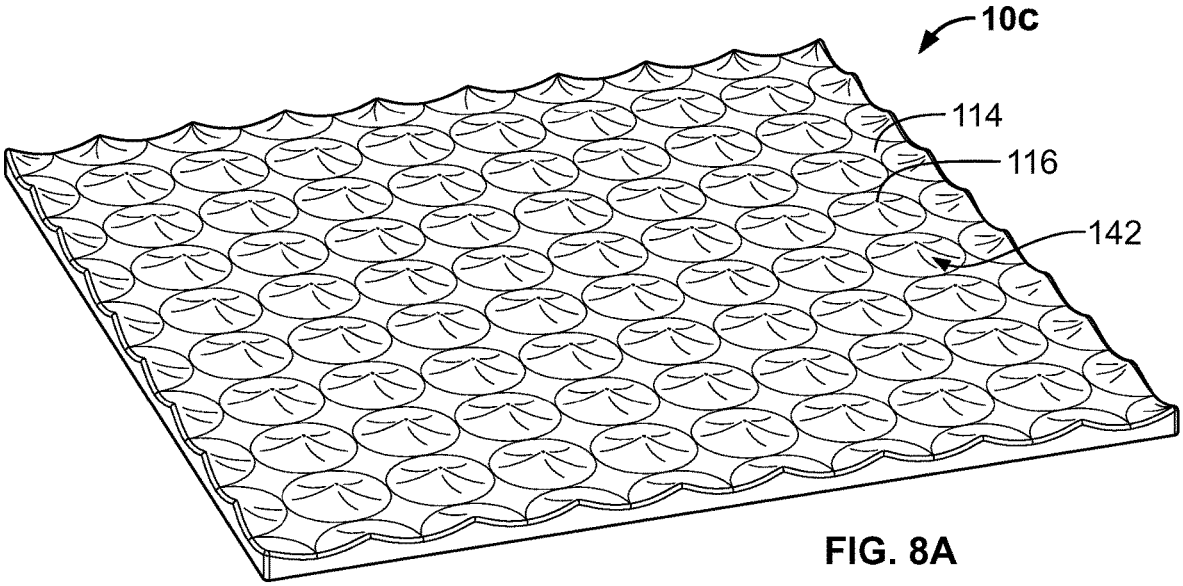
FIG. 8A is a perspective view of a third embodiment of the stabilizing panel.
Figure 8B:
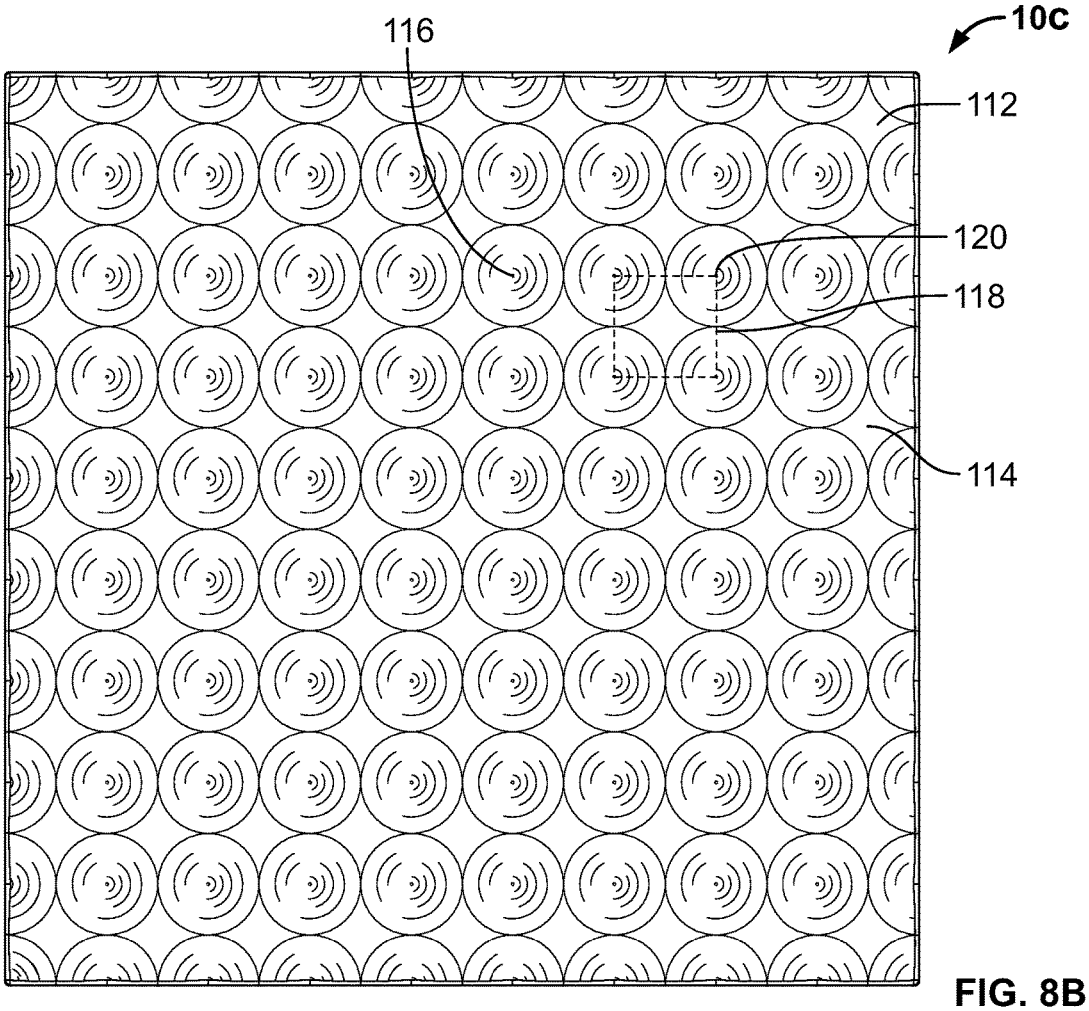
FIG. 8B is a top view of the third embodiment of the stabilizing panel.

Referring to FIGS. 8A-8B, a third embodiment of the stabilizing panel 10*c* is shown. In this embodiment, the first surface 112 can be divided into a plurality of parallelogram areas 118, where a peak 116 is located at each corner 120 of the parallelogram area 118 and in which a depression 114 is formed, similarly to the first embodiment. In contrast with the first embodiment, the first surface 112 of the third embodiment includes substantially cone-shaped protrusions 142. The protrusions 142 are shaped such that an outer surface joining the tip or peak 116 and the base are concave.

Figure 9A:
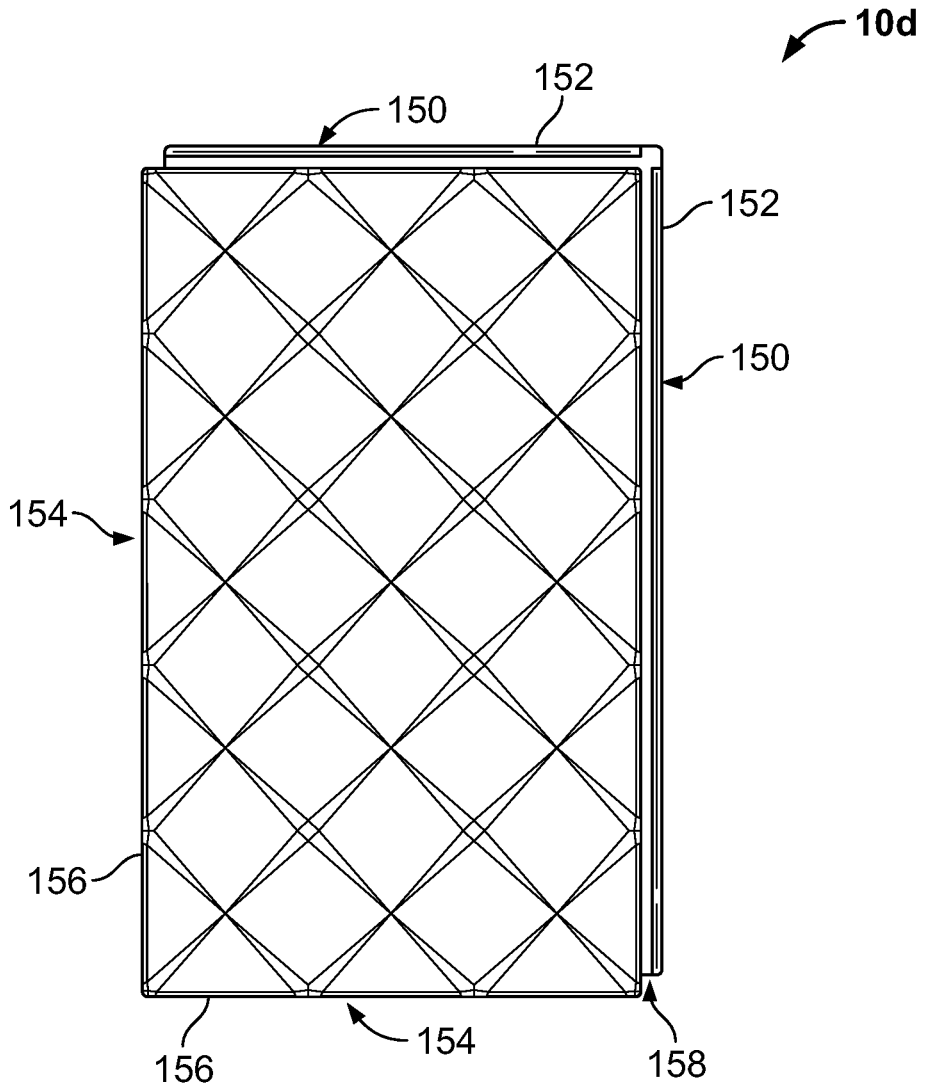
FIG. 9A is a top view of a fourth embodiment of the stabilizing panel with male connecting sections and female connecting sections.
Figure 9B:
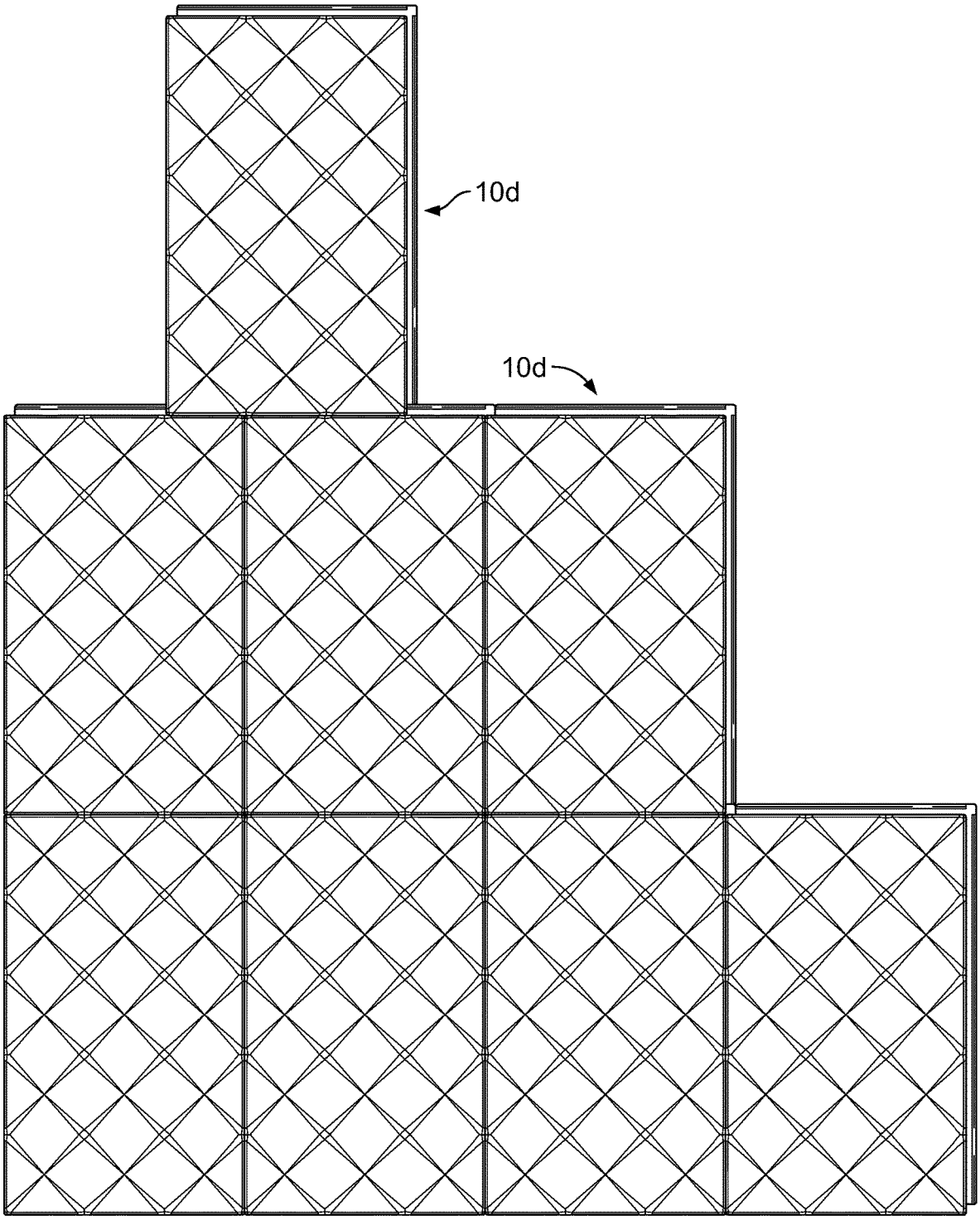
FIG. 9B is a top view of a plurality of stabilizing panels joined by the male connecting sections and the female connecting sections.
Figure 9C:
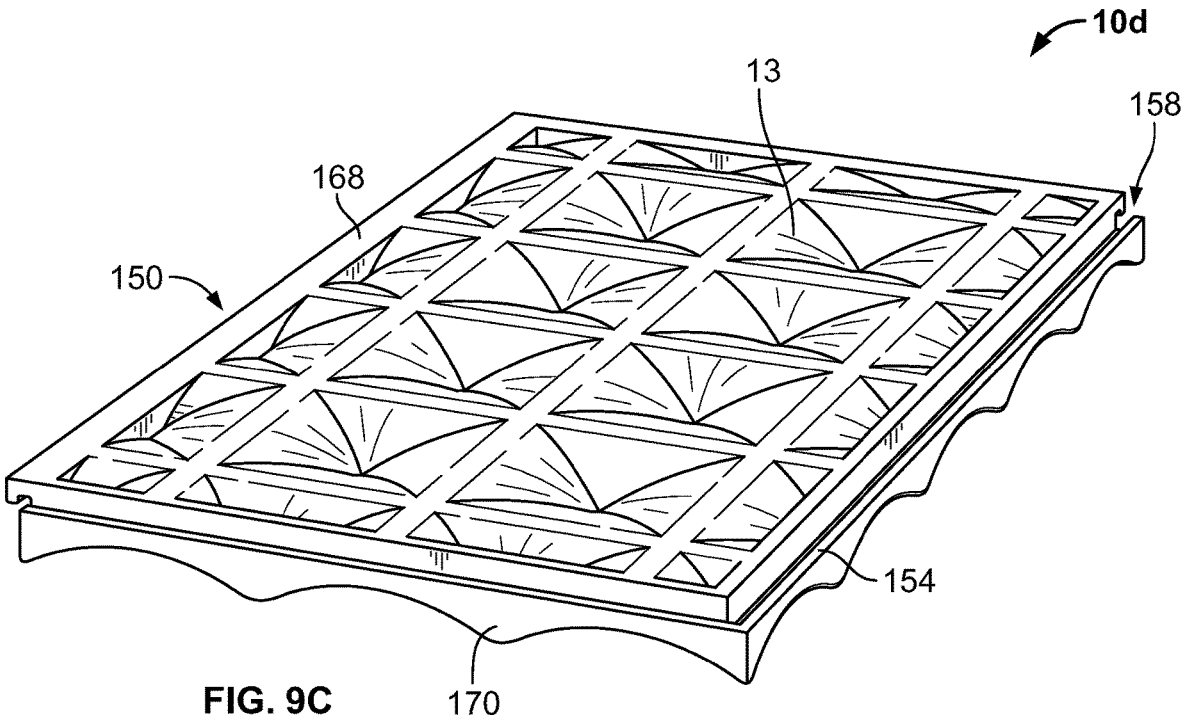
FIG. 9C is a perspective view of a second surface of the fourth embodiment of the stabilizing panel with a bottom layer and a top layer.

Referring to FIGS. 9A, a fourth embodiment of stabilizing panel 10*d* configured with features for securing together two or more stabilizing panels 10*d* (FIG. 9B) is shown. FIG. 9C shows the bottom of the stabilizing panel 10*d* on which male connecting sections 150 and female connecting sections 154 are formed with discontinuous sections 158. The stabilizing panel 10*d* may be described as having a two-layer periphery wherein a bottom layer 168 is offset about a top layer 170 in a diagonal or angled direction such that the edges of the bottom layer 168 become offset from the neighboring edges of the top layer 170.

The two-layer structure forms, on the stabilizing panel 10*d*, a male connecting section 150 extending substantially along each of a pair of adjacent first edges 152 and with a female connecting section 154 extending substantially along each of a pair of adjacent second edges 156. In this embodiment, the male connecting section 150 projects outwardly from each first edge 152 so as to form an L-shape while the female connecting section 154 is formed on the second surface 13 in an L-shape configuration. The second surface 13 may be flat or engraved as shown in FIG. 9C.

Figure 9D:
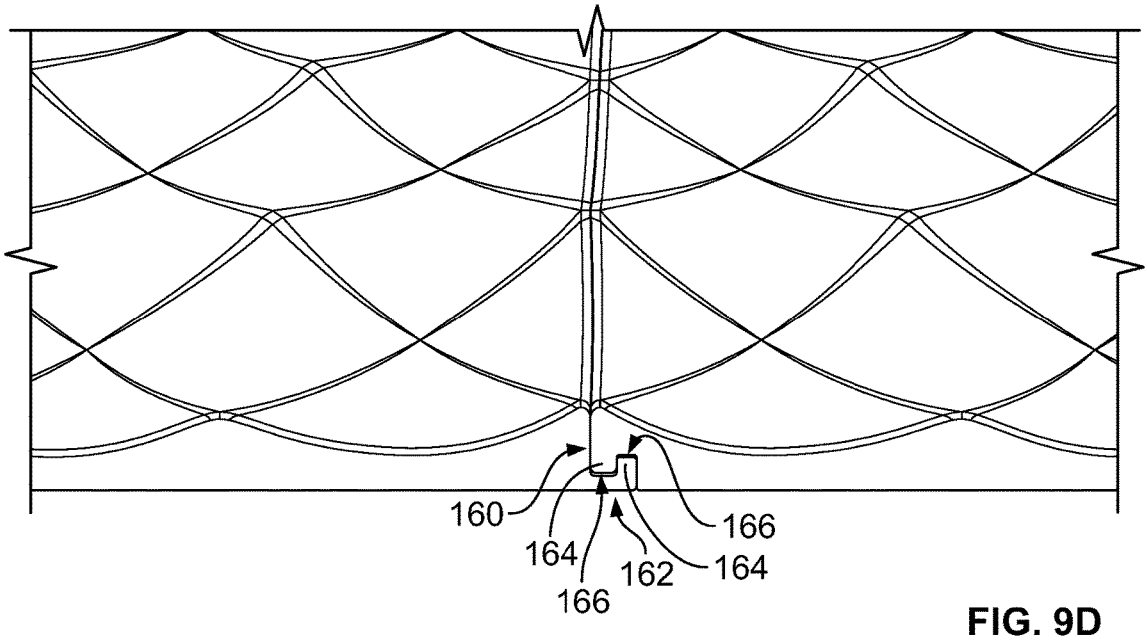
FIG. 9D is a close-up view of a boundary of two stabilizing panels.

As shown in FIG. 9D, the boundary of two neighboring stabilizing panels 10*d* is shown. A male connecting element 160 is formed on the male connecting section 150 while a female connecting element 162 is formed on the female connecting section 154. The male connecting element 160 and the female connecting element 162 may each include a tongue portion 164 that is vertically oriented and a groove portion 166 in which the tongue portion 164 of the other connecting element can be accommodated. The male connecting element 160 and the female connecting element 162 are shaped such that neighboring stabilizing panels 10*d* can interlock along the edges as shown in FIG. 9D.

The male connecting section 150 may be identical in length to the corresponding first edge 152 except that the male connecting section 150 is offset. As a result, the male connecting section 150 does not extend fully along the first edge 152 and the first edge 152 may include a discontinuous section 158. As shown in FIG. 9B, the discontinuous section 158 allows the stabilizing panels 10*d* to be placed next to one another without the male connecting section 150 of one stabilizing panel 10*d* overlying the male connecting section 150 of another stabilizing panel.

A number of examples have been described above. Nevertheless, it will be understood that various modifications may be made. For example, suitable results may be achieved if the described elements are combined in a different manner and/or replaced or supplemented by other elements or their equivalents. Accordingly, other implementations are within the scope of the following claims.

What is claimed is:

1. A stabilizing panel for placing items thereon, including:

a first surface including a plurality of parallelogram areas including four corners and four sides, each corner of the parallelogram areas including a peak, the peaks aligned so as to be parallel with one of the four sides of the parallelogram areas on the first surface, and each of the parallelogram areas defining a depression having at least a portion being a linear depression of constant elevation extending between single points of opposed sides of the four sides, each point being intermediate the two corners bounding the respective side;

a pair of adjacent first edges, each first edge configured with a male connecting section; and a pair of adjacent second edges, each second edge configured with a female connecting section configured to interlock with a male connecting section of a neighboring stabilizing panel, the pairs of first and second edges together bounding the first surface.

2. The stabilizing panel of claim 1, the male connecting section extending substantially along each first edge, the female connecting section extending substantially along each second edge.

3. The stabilizing panel of claim 1, each of the male connecting sections and the female connecting sections including a tongue portion and a groove portion configured to accommodate the tongue portion of the neighboring stabilizing panel.

4. The stabilizing panel of claim 1, including a two-layer periphery with a top layer and a bottom layer offset in an angled direction from one another such that edges of the top layer are offset from neighboring edges of the bottom layer.

5. The stabilizing panel of claim 1, wherein at least one of the male connecting section and the female connecting section is discontinuous along the first edge and the second edge, respectively.

6. The stabilizing panel of claim 1, wherein the male connecting section and the female connection section are L-shaped.

7. The stabilizing panel of claim 1, wherein the single points bounding the linear depression each are disposed centrally between the respective corners bounding the respective sides.

8. The stabilizing panel of claim 1, further comprising a second surface forming a second side of the panel facing a direction that is opposite from a direction that the first side of the panel faces and having an area that corresponds with an area of the first surface, the second comprising a plurality of substantially flat areas.

9. The stabilizing panel of claim 1, wherein a center of each of the parallelogram areas is at a first elevation, the peaks are at a second elevation, and the second elevation is greater than the first elevation.

10. The stabilizing panel of claim 1, wherein each parallelogram area is arranged such that at least one of the four sides of one of the parallelogram areas is bounded by one of the four sides of another of the parallelogram areas.

11. The stabilizing panel of claim 1, wherein all of the parallelogram areas include only one depression and are equal in size.

12. The stabilizing panel of claim 1, wherein the first surface comprises an elastomer.

13. The stabilizing panel of claim 1, wherein the first surface is slip resistant.

14. The stabilizing panel of claim 1, wherein the entire first surface is divisible into a plurality of complete parallelogram areas.

15. The stabilizing panel of claim 1, wherein the complete depression is defined by the linear depression portion and another linear depression portion intersecting the linear depression portion within the four sides bounding the respective parallelogram.

16. The stabilizing panel of claim 15, wherein the another linear depression portion extends between single points of another pair of opposed sides of the four sides, each point being intermediate the two corners bounding the respective side.

17. The stabilizing panel of claim 15, wherein the linear depression portions and another linear depression portions of the plurality of parallelograms connect to form a single lattice of linear depression portions.

18. The stabilizing panel of claim 1, wherein a constant radius of curvature extends fully along each side of each respective parallelogram from a first peak bounding each respective side to a second peak bounding the same respective side.

19. The stabilizing panel of claim 18, wherein each constant radius of curvature is equal to each other constant radius of curvature.

20. The stabilizing panel of claim 18, wherein each constant radius of curvature has an axis, and wherein the four axes of the four respective constant radiuses of curvature of each parallelogram are co-disposed in a single plane and include the linear depression.

21. The stabilizing panel of claim 1, further defined by the first surface including a plurality of different parallelogram areas each being offset from and including portions of multiple of the plurality of parallelogram areas, the plurality of different parallelogram areas each including a including four corners and four sides extending therebetween, and a central area of each different parallelogram area including a single peak, wherein the sides are aligned so as to each be contiguous with one of the four sides of an adjacent different parallelogram area on the first surface, and wherein the shared sides of adjacent different parallelogram areas each define a linear depression or another linear depression intersecting the linear depression.

22. The stabilizing panel of claim 21, wherein for each of the different parallelogram areas, diagonal lines connect the peak with each of the respective four corners, and wherein all points between the peak and the four corners on the diagonal lines are at elevations higher than an elevation of the four corners.

23. A stabilizing panel for placing items thereon, including:

a first surface including a plurality of parallelogram areas including four corners and four sides, a central area of each parallelogram area including a single peak, the sides aligned so as to each be contiguous with one of the four sides of an adjacent parallelogram area on the first surface, and wherein the shared sides of adjacent parallelogram areas each define an integrated latticed depression of the first surface that defines the sides of each parallelogram area of the plurality of parallelogram areas and which integrated latticed depression has a constant elevation;

a pair of adjacent first edges, each first edge configured with a male connecting section; and a pair of adjacent second edges, each second edge configured with a female connecting section configured to interlock with a male connecting section of a neighboring stabilizing panel, the pairs of first and second edges together bounding the first surface.

24. The stabilizing panel of claim 23, wherein for each of the parallelogram areas, diagonal lines connect the peak with each of the respective four corners, and wherein all points between the peak and the four corners on the diagonal lines are at elevations higher than an elevation of the four corners.

* * * * *